US005281459A

United States Patent [19]

Van Eijck

[11] Patent Number: 5,281,459

[45] Date of Patent: Jan. 25, 1994

[54] SAFETY TILE, AS WELL AS COVER PLATE TO BE USED THEREWITH

[75] Inventor: Richard J. F. Van Eijck, LH Halsteren, Netherlands

[73] Assignee: Rubet International B.V., LH Halsteren, Netherlands

[21] Appl. No.: 870,964

[22] Filed: Apr. 20, 1992

[30] Foreign Application Priority Data

May 1, 1991 [NL] Netherlands ..... 9100744

[51] Int. Cl.[5] ..... E04F 13/08; E04C 2/38; B32B 3/06

[52] U.S. Cl. ..... 428/100; 428/48; 428/99; 428/120; 52/436; 52/598; 404/33; 404/44

[58] Field of Search ..... 428/48, 99, 100, 119, 428/120; 52/436, 598; 404/33, 44

[56] References Cited

U.S. PATENT DOCUMENTS 3,950,908 4/1976 Van Eyk ..... 52/436

FOREIGN PATENT DOCUMENTS 139028 11/1973 Netherlands .
649798 6/1985 Switzerland .

*Primary Examiner*—Alexander S. Thomas
*Attorney, Agent, or Firm*—Foley & Lardner

[57] ABSTRACT

The invention relates to a safety tile, including a tile body of rigid material, such as concrete, and a cover plate provided with an enclosing edge and being of an elastically flexible material, such as rubber. The cover plate has ribs integrally formed therewith uniformly distributed at its bottom side directed towards the tile body, of which the bottom ends hang down and rest on the upper surface of the tile body. The ribs extend diagonally across the bottom side of the plate with main diagonals extending between two opposite corners of the cover plate. Near each of the two opposite corners, each main diagonal rib has a widened bearing face which forms the basis of a locking part connected therewith, which locking parts have been locked in the tile body.

17 Claims, 4 Drawing Sheets

SAFETY TILE, AS WELL AS COVER PLATE TO BE USED THEREWITH

BACKGROUND OF THE INVENTION

1. Field of the Invention

The invention relates to a safety tile, consisting of a tile body of rigid material, such as concrete, and a cover plate provided with an enclosing edge and being of an elastically flexible material, such as rubber. The cover plate has ribs integrally formed therewith uniformly distributed at its bottom side directed towards the tile body. The ribs are spacing members, of which the bottom ends hanging down rest on the upper surface of the tile body. Also integrally formed therewith are locking parts, which are longer than the spacing members, and have their ends protruding beyond the spacing members locked in the tile body, and also locked to a cover plate to be used therewith.

2. Discussion of the Related Art

One example of a safety tile is known from a Dutch Patent Specification 181,881. This concerns a safety tile, consisting of a concrete tile, covered by a cover plate of rubber, in which spacing ribs have been made at mutually equal distances and parallel to the edges of the tile on a regular square pattern. A locking body is made in the cover plate and formed integrally therewith, and is situated near each corner of the square tile. These locking bodies consist of a thickened bottom part of the same height as the spacing ribs with a mushroom-shaped locking body protruding beyond it. In mounting these tiles, one uses prefabricated concrete tiles, which have a cavity near their four corner for receiving the mushroom-shaped locking means. These cavities are filled with cement or another suitable type of kit. The cover plate is then positioned onto the tile body with the locking means in the cement, which is still wet, and the ribs lying against the top side of the tile body. After drying and setting of the cement, the concrete tile and the cover plate form an inseparable unity, which represents an efficient safety tile.

Thanks to the regular pattern of the spacing ribs, a good distribution of pressure across the cover plate occurs with loading, while the air cavities enclosed between the ribs guarantee a good resiliency.

Of great importance with a safety tile, is the absorption of pressure on impact load, as can occur when, for example, a playing child suddenly falls, for example, from a climbing frame, and hits its head or another part of the body on such a safety tile. With such an impact load it is important that the locally applied pressure is distributed as much as possible across the entire tile surface. If such an impact load occurs in the middle of the tile, the ribs will be able to provide a sufficient diversion of pressure. However, this is different, if the impact load occurs at one of the corners of such a tile, where the locking part is situated. The impact pressure on such a locking part is primarily absorbed locally. The consequence is that no sufficient diversion of pressure can occur. In the exemplary situation that a child hits its head or another part of the body precisely in that place, it could get seriously injured.

SUMMARY OF THE INVENTION

It is an object of the invention to provide a safety tile of the type mentioned above, in which the properties with respect to shock absorption have been improved, and in which the tile meets the most stringent safety requirements.

It is also an object of the invention to provide a safety tile, which can be manufactured and mounted in a simple and economical manner.

To that and, the invention provides a safety tile, as described herein, characterized in which the spacing members consist of a regular cross-hatch pattern of ribs extending diagonally across the bottom side of the cover plate. Main diagonals extend between two opposite corners of the cover plate. Each main diagonal rib has a widened bearing face near each of the two opposite corners, which forms the basis of a locking part connected therewith.

Besides maintaining the advantageous properties of the safety tile according to Patent Specification 181881, the safety tile according to the invention has the following advantages:

1. Because of the diagonal arrangement of the spacing ribs and through the main diagonals extending between opposite corners, a diversion of pressure through this diagonal can occur in each corner area of the tile.

2. By forming the locking parts with a widened bearing face, (the widened bearing face being a widening and integral with the main diagonals), there is no "single point" shock absorption at these locking parts. A distribution of pressure and diversion of pressure will occur there as well, by which these danger zones of the known tile have been eliminated effectively.

Effectively, in an embodiment of the invention, each widened bearing face lies against a main diagonal rib between two successive and ribs, that cross this main diagonal rib. Evidently in this way an optimal shock absorption is obtained at such a locking part.

The term cross-hatch pattern is always used hereinabove in connection with the diagonal arrangement of the ribs. In case the tile is a rectangle with different length and width dimensions, one can speak of an actual cross-hatch pattern. In practice, most safety tiles are square, in which case the ribs form a diagonal pattern of squares.

In another effective embodiment, each locking part has a stem connected with its bearing face, which stem is smaller in cross-section than the bearing face. Under these circumstances, the bearing face has a similar efficient carrying function as the bearing shoulders according to Dutch Patent Specification 181,881. However, the great advantage of the invention is that these bearing faces form an extension of diagonal ribs, which can provide for further diversion of pressure.

As in Dutch Patent Specification 181,881, the cover plate can be mounted onto prefabricated tiles provided with receiving cavities for the locking parts. In that case, mounting takes place by filling these cavities with a curable type of kit, such as synthetic resin mortar, cement etc., and subsequently pressing the cover plates with the locking means into these cavities, which is followed by drying and curing of the kit.

However, it is also possible to provide the cover plate with a closing plate, which lies against the ribs and is provided with openings, through which the locking parts protrude. With a cover plate made like this, manufacturing the tile takes place by putting the cover plate turned upside down into a tile form and subsequently casting concrete. The closing plate prevents the necessary air cavities between the ribs from getting filled with concrete. This closing plate, which, so to speak forms the top side of the tile body after manufacturing the tile, plays no role in the properties of the cover plate. This closing plate can be relatively thin, but has to be sufficiently strong to be able to bear the cast concrete.

It is mentioned that it is known, from the Dutch Patent Specification 139,028, to use a closing plate of hardboard with casting concrete onto a rubber covering, in order to prevent the concrete from filling up the space to be kept open in the rubber covering. There, it concerns a loose plate, which is laid onto the cover plate upon casting.

BRIEF DESCRIPTION OF THE DRAWINGS

The invention will now be further explained by means of an embodiment referring to the drawings. In the drawings.

In all figures, like reference numbers are used for like parts.

DETAILED DESCRIPTION OF THE PREFERRED EMBODIMENTS

Figure 1:
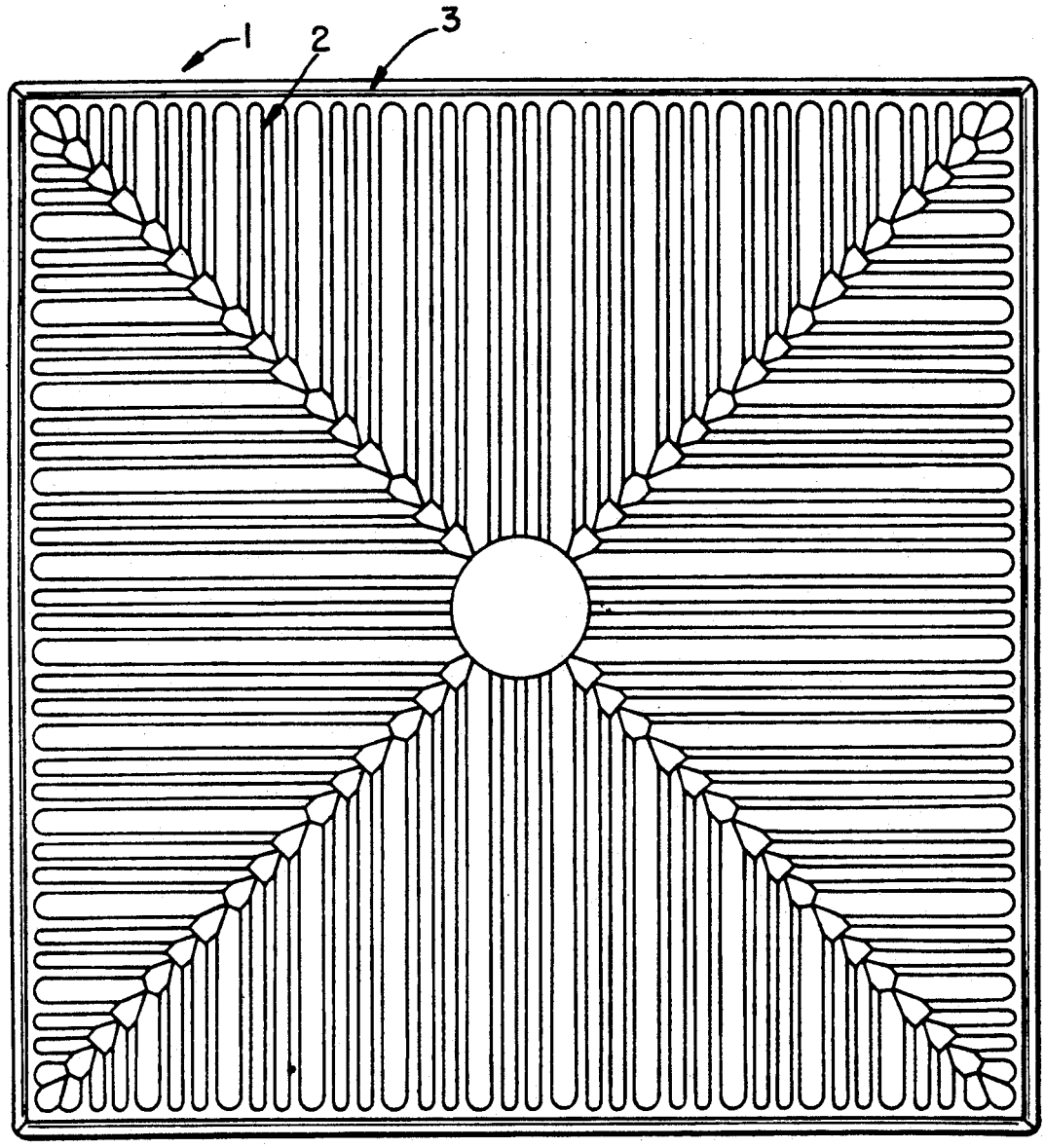
FIG. 1 shows a cover plate of a safety tile according to the invention in plan view.

As shown in FIG. 1, a cover plate 1 is square-shaped in cross-section and intended for a typically plate 1 square safety tile. The cover plate 1, which is made of rubber or a similar elastic material, has, as can be seen in FIG. 1, a top layer 2 with an embossment of fine grooves, meant as antislip layer. The cover plate is enclosed on all sides by a downwardly bent edge 3 formed integrally with the cover plate.

Figure 2:
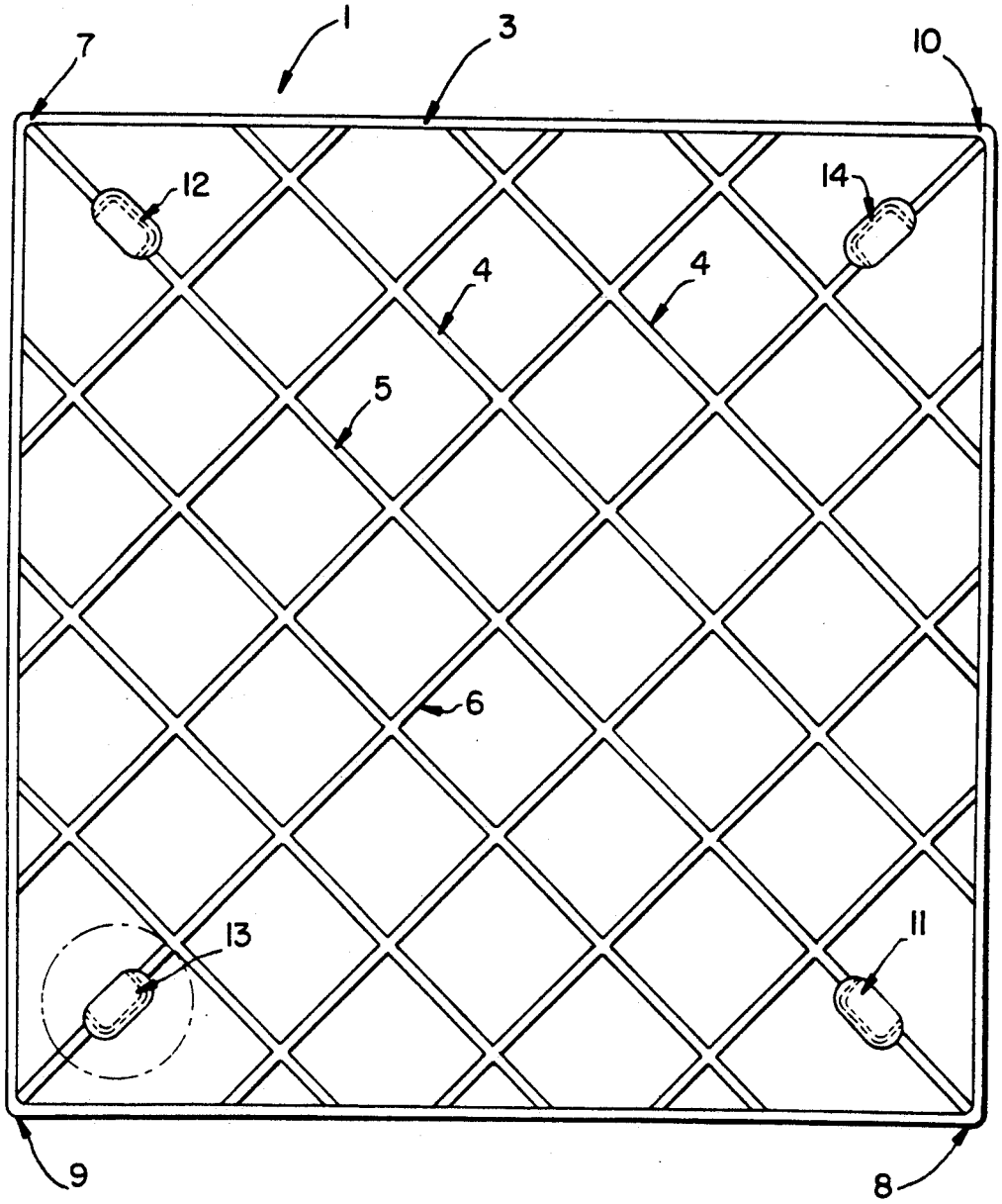
FIG. 2 shows bottom view of this cover plate in bottom view.
Figure 3:
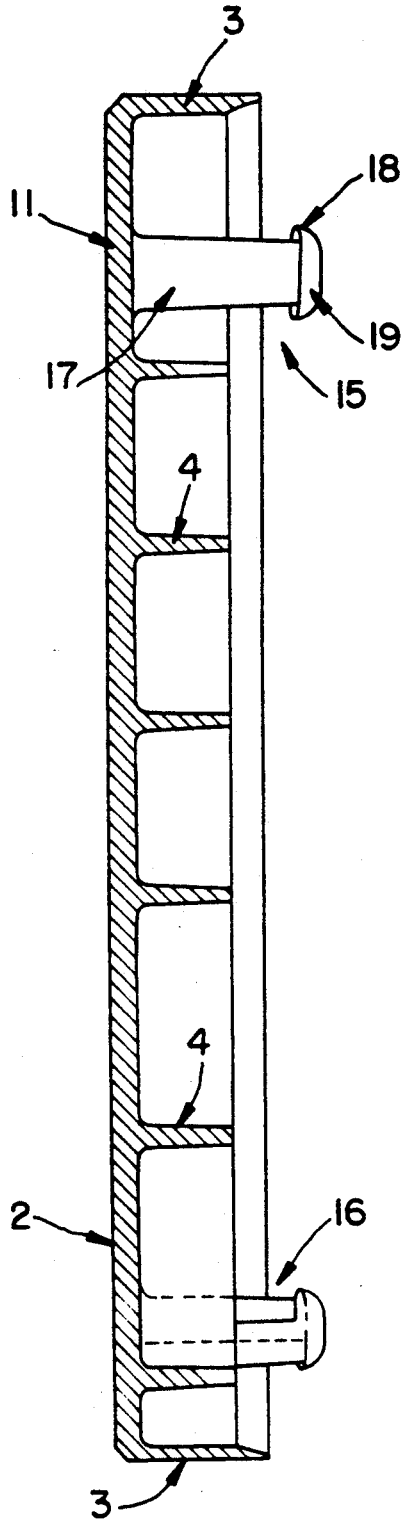
FIG. 3 shows a transverse/diagonal sectional view of FIG. 1.

As can be seen in FIGS. 2 and 3, the cover plate 1 has a regularly distributed pattern of ribs 4 on its bottom side which is to be turned towards the tile. These ribs extend diagonally and enclose square rhombs. Both of the main or corner diagonals 5 and 6 are the diagonals between the opposite corners 7, 8 and 9, 10 of the tile respectively.

Thus far, the design of the tile cover plate corresponds to that according to Dutch Patent Specification 181,881 mentioned before, with a difference. That is, in Dutch Patent Specification 181,881, the ribs extend parallel to the tile edges and not diagonally, as with the invention. As in the tile shown in FIGS. 1 and 2 of Dutch Patent Specification 181,881, the cover plate has four locking parts near the four corners, integrally formed with the cover plate, and serving to lock the cover plate in the tile body. However, a significant difference between the invention and the known construction is the way of fastening the locking parts to the cover plate. As can be seen in FIG. 2, each of the main diagonals 5, 6 shows widened parts 11, 12 and 13, 14 respectively near the opposite corners 7, 8 and 9, 10 respectively, which widened parts serve as bearing faces for the locking parts. It is also possible to locate the position of these widened bearing faces between two ribs crossing the main diagonal concerned near the corner concerned.

One locking part has been mounted on each bearing face, of which only the locking parts 15 and 16 can be seen in FIG. 3. As can be seen, the locking part 15 has a stem 17, which rests on the locking part 15. The stem 17, outwardly slightly narrowing, shows a widened anchor-shaped body 18 at the end part to be mounted in the concrete. The bottom end surfaces 19 of the body 18, as can be seen in FIG. 3, are hemispheric or bevelled to an angle of 45°, in order to facilitate pressing the locking parts into synthetic resin mortar or grout during mounting of the cover plate on a concrete tile.

Figure 4:
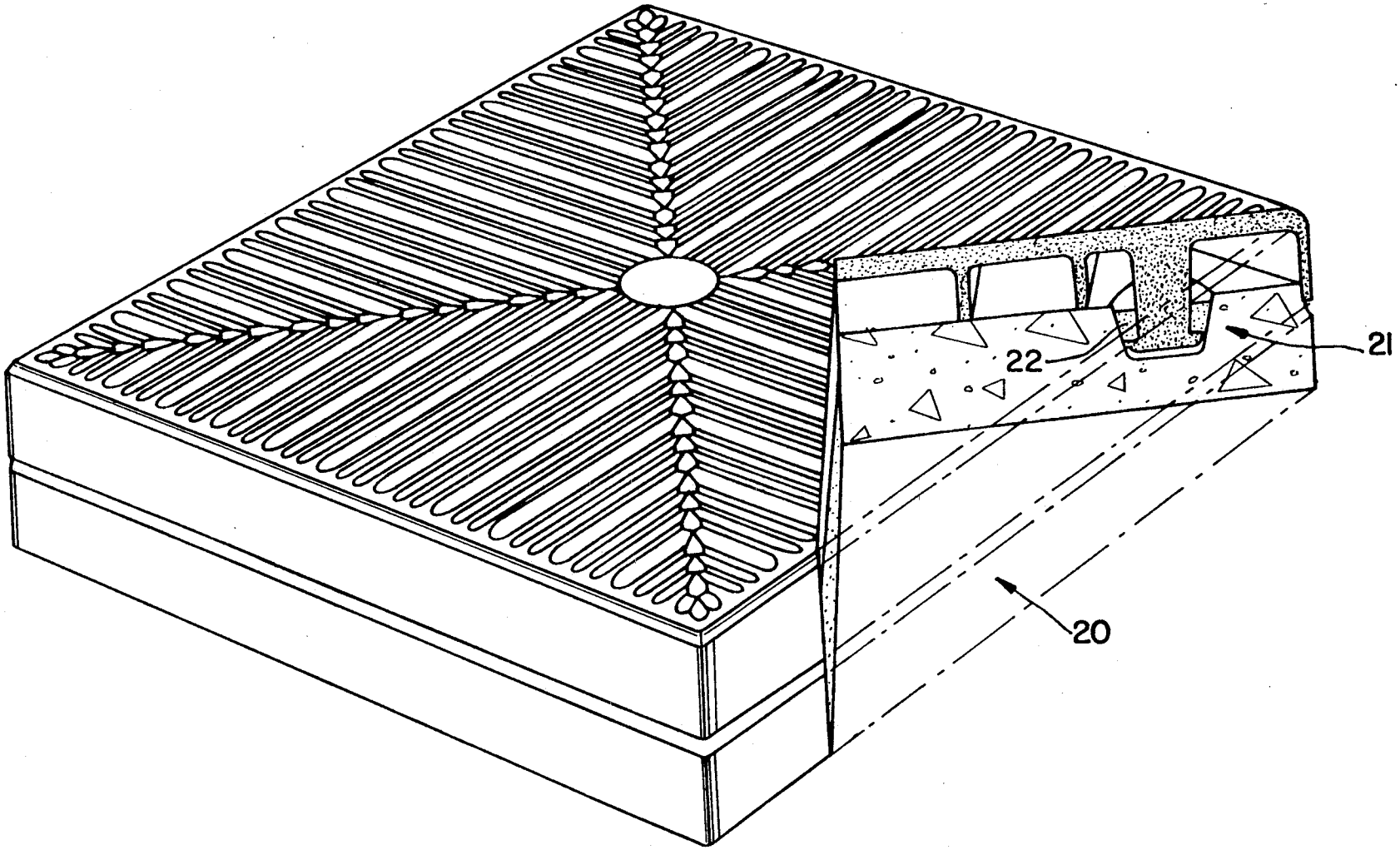
FIG. 4 shows a complete safety tile according to the invention in perspective and partly laid open.

As shown in FIG. 4, a tile plate formed in this way can be mounted on a concrete tile (20) in the same manner as indicated in Patent Specification 181881, which concrete tile has receiving cavities (21) near its corners, for the locking means, which can be cemented (22) therein. For this manner of securing the cover plate on the tile, reference is made to Dutch Patent Specification 181881.

However, it is also possible that the cover plate is not secured on a prefabricated concrete tile. Instead, the cover plate may be put upside down into a tile form, after which concrete is cast in the way as described in the Dutch Patent Specification 139028 mentioned before. In that case, however, the inside of the tile should be covered, since a resilient safety tile should have necessary air cavities in the rubber upper layer in view of the required elasticity. According to the invention, the cover plate 1 can therefore be efficiently equipped with a closing plate (not shown) pre-mounted therewith, which lies against the spacing ribs 4, but allows the locking means 15, 15 through by suitable openings. Owing to such pre-mounting, tile casting in forms can be done rapidly and efficiently, and the result is completely equivalent to the result obtained according to the way of mounting mentioned before.

In each case, a safety tile is obtained in which the resiliency is balanced, such that pressure on the upper layer is distributed and absorbed uniformly across the entire surface. Moreover, the tile is extraordinarily effective in absorbing impact loads, not just in the middle, but also when the impact load occurs near a corner of the tile. Due to the fact that the locking parts are, so to speak, coupled to the main diagonals of the rib pattern, a very efficient diversion of pressure takes place there as well. Thus, sudden high pressures can be diversed and distributed across the tile, which strongly reduces the risk of injuries to someone falling hard on such a tile.

Although the invention has been discussed in detail in the above by means of an embodiment, it will be obvious, that it is not limited to this embodiment, and that many variations and modifications are possible. For example, the tile does not have to be absolutely square, but it can also have another shape, for example rectangular. It is also possible that the cover plates of the tile are not used for separate tiles, but, for example, are laid together on a concrete floor, in which it is further possible that previously made receiving cavities for the locking means are situated in this concrete floor, or that the concrete floor is cast wet and the cover plates are laid thereon, before the concrete has set.

Further variations and modifications will be obvious to the expert after reading the above.

I claim:

1. A safety tile comprising:

(a) a cover plate of elastically flexible material with a top layer, a bottom side, and a plurality of corners;

(b) a plurality of ribs integrally formed thereon extending diagonally, uniformly distributed on the bottom side, forming a cross-hatch pattern, including at least one main diagonal rib extending between opposite corners;

(c) at least one bearing face, formed integrally on one main diagonal rib adjacent to one corner; and (d) at least one locking part, formed integrally with one of the ribs on the bearing face.

2. The safety tile according to claim 1, further comprising an edge enclosing the cover plate.

3. The safety tile according to claim 2, wherein the edge is downwardly bent and formed integrally with the cover plate.

4. The safety tile according to claim 1, the bearing face being a widened part of the diagonal rib.

5. The safety tile according to claim 1, the ribs including at least two successive end ribs crossing the main diagonal rib, the bearing face being formed on the main diagonal rib between two successive end ribs.

6. The safety tile according to claim 1, wherein the cover plate has a square shape, and wherein the ribs form a diagonal pattern of squares.

7. The safety tile according to claim 1, each locking part having a stem connected to the bearing face, and a widened body at an end of the stem.

8. The safety tile according to claim 7, wherein the widened body is anchor-shaped.

9. The safety tile according to claim 1, further comprising a tile body of rigid material disposed adjacent to the bottom side of the cover plate, the locking parts being connected therewith.

10. The safety tile according to claim 9, wherein the rigid material is concrete.

11. The safety tile according to claim 9, the tile body being cavitated to define a plurality of cavities, the lock parts being connected to the tile body at the cavities.

12. The safety tile according to claim 1, further comprising a closing plate having a plurality of openings, mounted on the bottom side of the cover plate lying against the ribs, the locking parts projecting through the openings, forming a unit.

13. The safety tile according to claim 1, further comprising a floor on which the cover plate is disposed, the locking parts connected to the floor.

14. A safety tile comprising:

(a) a substantially square-shaped cover plate of elastically flexible material with a top layer, a bottom side, and a plurality of corners;

(b) a plurality of ribs integrally formed thereon extending diagonally, uniformly distributed on the bottom side of the cover plate, forming a cross-hatch pattern, including a plurality of main diagonal ribs extending between opposite corners;

(c) a widened bearing face, formed integrally on each main diagonal rib adjacent to each corner; and (d) a locking part on each bearing face, including a stem integrally formed with the bearing face, and a widened body formed on an end of the stem.

15. The safety tile according to claim 14, further comprising a tile body connected to the locking parts.

16. The safety tile according to claim 14, further comprising a closing plate having a plurality of openings, mounted on the bottom side of the cover plate, lying against the ribs, the locking parts projecting through the openings, forming a unit.

17. The safety tile according to claim 16, further comprising a casting material disposed under the cover plate, the closing plate and the ribs defining a plurality of cavities therebetween.

* * * * *